United States Patent [19]

Gartner

[11] Patent Number: 4,458,745

[45] Date of Patent: Jul. 10, 1984

[54] DEVICE FOR CONTROLLING THE TEMPERATURE OF ROOMS IN A BUILDING

[75] Inventor: Karl Gartner, Gundelfingen, Fed. Rep. of Germany

[73] Assignee: Josef Gartner & Co., Fed. Rep. of Germany

[21] Appl. No.: 353,084

[22] Filed: Mar. 1, 1982

Related U.S. Application Data

[63] Continuation of Ser. No. 80,451, Oct. 1, 1979, abandoned.

[30] Foreign Application Priority Data

Feb. 2, 1979 [DE] Fed. Rep. of Germany ..... 2904005
Apr. 4, 1979 [DE] Fed. Rep. of Germany ..... 2913598

[51] Int. Cl.[3] ..... F24H 00/00; F24D 00/00

[52] U.S. Cl. ..... 165/57; 165/53; 165/56; 165/49; 98/40 C; 285/191

[58] Field of Search ..... 165/49, 53, 54, 56, 165/57, 169, 170; 237/43, 69; 98/30, 31, 40 C; 52/303

[56] References Cited

U.S. PATENT DOCUMENTS

| | | | |
|---|---|---|---|
| 2,184,113 | 12/1939 | Calajati | 165/49 |
| 2,520,446 | 8/1950 | Thrush | 237/69 |
| 3,049,341 | 8/1962 | Kemp | 165/56 |
| 3,415,024 | 12/1968 | Kotlary | 165/49 |
| 3,795,272 | 3/1974 | Kahn et al. | 165/54 |
| 4,011,989 | 3/1977 | Diggs | 237/69 |
| 4,121,653 | 10/1978 | Viny | 165/49 |
| 4,203,487 | 5/1980 | Gartner | 165/49 |

FOREIGN PATENT DOCUMENTS

| | | | |
|---|---|---|---|
| 2020643 | 11/1971 | Fed. Rep. of Germany | 98/31 |
| 2132921 | 1/1973 | Fed. Rep. of Germany | 237/69 |
| 2364013 | 8/1975 | Fed. Rep. of Germany | 165/49 |
| 1463748 | 12/1966 | France | 165/49 |

*Primary Examiner*—William R. Cline
*Assistant Examiner*—Edward P. Walker
*Attorney, Agent, or Firm*—Jerome P. Bloom

[57] ABSTRACT

A device for controlling the temperature of rooms in a building comprising curtain walls having a skeleton made up of columns and horizontal members to which facade elements and, if required, window surfaces are secured so as to be substantially free from heat bridges, comprising a temperature-control facility substantially in the form of a pipeline system in which a heat transfer fluid flows, said pipeline system being constructed and arranged to dispose inside the room and adjacent the skeleton of columns and horizontal members and relative to the skeleton so as to produce a thermal coupling between the skeleton and the temperature control facility. In certain applications the temperature control facility is disposed at a relatively short distance from and in facing relation to the skeleton in an arrangement producing a close radiation coupling between the skeleton and the temperature control facility.

27 Claims, 15 Drawing Figures

Figure 1A:
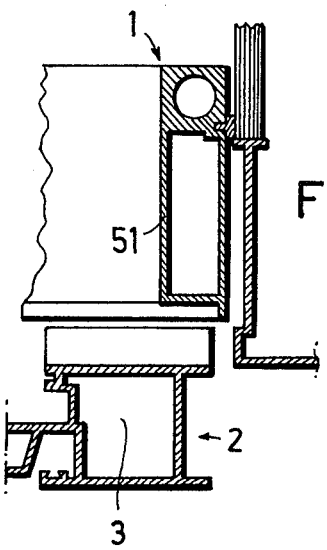

FIG.3
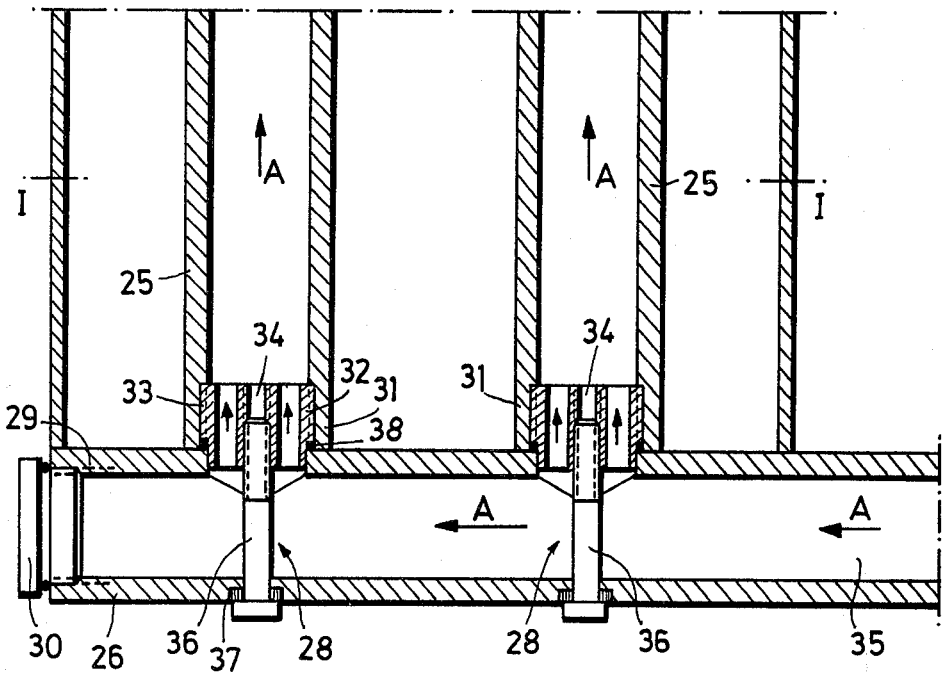
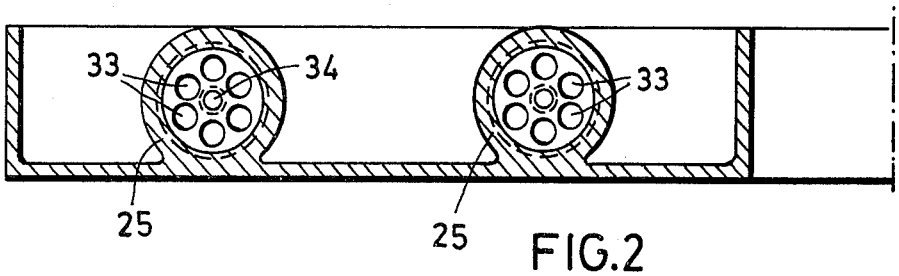
FIG.2

FIG.4
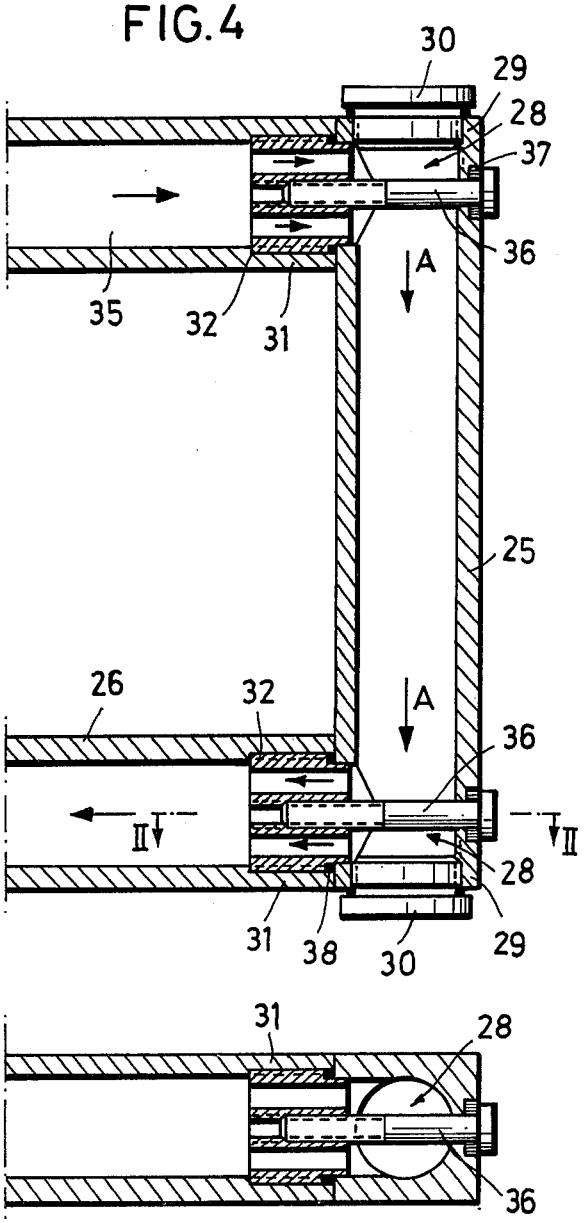
FIG.5
FIG.6
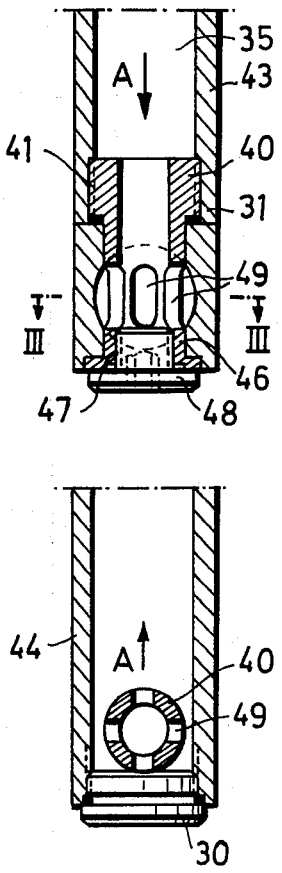
FIG.7

DEVICE FOR CONTROLLING THE TEMPERATURE OF ROOMS IN A BUILDING

This application is a continuation of application Ser. No. 080,451, filed Oct. 1, 1979, now abandoned.

BACKGROUND OF THE INVENTION

This invention relates to a device for controlling the temperature of rooms in a building comprising curtain walls having a skeleton made up of columns and horizontal members to which facade elements and, if required, window surfaces are secured so as to be substantially free from heat bridges.

If a room temperature and the environmental temperature, when the air is substantially stationary, are about 20° C., the room is comfortable. However, when using prior art metal front walls or curtain walls, the maintenance of such a temperature in a room of a building has not been possible. Most undivided metal structural or skeleton members comprise vertical uprights and horizontal members which bear front or curtain walls and are so constructed that they do not provide thermal insulation or resist the transmission of heat and are thus equivalent to ordinary sheet metal walls. Consequently, if people in the room stay near the curtain walls, they lose considerable heat by way of the cold metal structural members during the winter period. By contrast, in the summer the uprights and horizontal members of the skeleton of the metal wall are heated by solar radiation and in turn heat the room and reduce the comfort of persons inside of the room because of the heat transmitted from the curtain structure. This is emphasized when the metal skeleton is anodised or painted in dark colors, as is common nowadays. It is not uncommon for rooms to be heated to 36° C. or more in summer.

Efforts have been made to obviate this difficulty using a temperature-control or "induction" air conditioning plant which comprises a central temperature-control installation and an induction device in each room to which the central installation is connected by way of pipes. The arrangement requires an inlet and an outlet for the heat-supplying material, an inlet and outlet for a heat-removing material, and a supply pipe for primary air. These pipes must be separately directed to each induction device in each room. A disadvantage of such an installation is that it is very expensive to build, uses a great deal of energy during its operation and in the operation thereof it causes the dirt in the individual rooms to be continuously disturbed, to the discomfort of the occupants. Another disadvantage of this induction type installation is that it has practically no effect on the temperature of the room in the area of "radiation holes", that is wall regions of a room the temperature of which is very different from the average room temperature. A typical example of a radiation hole is that in the area of a glass window which, in summer, may add heat to the metal wall construction at the periphery of the room through solar radiation.

It has also been known to control the temperature of outer rooms of a building the outer wall structure of which is comprised of a skeleton made up of hollow columns and hollow horizontal members mounting facade elements and having window units in connection therewith by conveying heat transfer fluid inside the skeleton between an inlet thereto and an outlet therefrom and causing a flow of temperature conditioning fluid to occur in reference to the wall structure in a predetermined manner. In utilizing a system such as this cold or warm parts of the metal skeleton of a room wall on the outer side of a building can be controlled as to temperature so that the room interior becomes comfortable. The disadvantage of such a temperature-control facility is that the metal skeleton must comprise a flow path for the heat transmitting medium. Therefore, temperature control facilities of this kind must be included in the original design and construction of a building. It is practically impossible to incorporate such facilities in existing buildings. Another disadvantage of the facility wherein the total skeleton is the conduit for the heat transmitting or transfer medium is that the skeleton parts generally have a hollow which is relatively large in cross section and therefore a relatively large amount of heat transmitting or transfer medium is required for its circulation and control of temperature. This considerably slows down the rate at which adjustments can be made in a room temperature.

The primary object of the present invention is to provide a facility for controlling the temperature of rooms in a building such that the facility does not need to be included in the original design and construction of the building but can easily and very inexpensively be incorporated in existing buildings. Embodiments of the invention provide for rapid and simple control of room temperature and in a manner to maintain the comfort of its occupants under essentially all conditions.

A temperature-control facility according to the invention is provided substantially in the form of a pipe line system, in the pipe or pipes of which a heat transfer fluid forms. This pipe line system is disposed inside a room or rooms of a building and adjacent the metal skeleton of the vertical columns and horizontal beams providing the base of its or their outside wall. The pipe line system is so arranged as to produce a thermo coupling between it and the metal skeleton. The advantageous result is an indirect transmission of heat from the hot to the cold side of this arrangement. Where the system is applied to rooms at opposite outer sides of a building, arrangement can be made for heat transfer fluid from the system in the room or rooms on the sunny side of the building to move to the system at the shady side of the building. In this way, the heat from the portion of the building facade structure exposed to the sun can be transferred to the heat transfer fluid and carried thereby to the system at the shady side of the building to warm the rooms at that side to a comfortable temperature. At the same time, the rooms at the sunny side are relieved of excess heat which might otherwise cause discomfort to their occupants.

A temperature control facility of the invention, which is aligned relative the skeleton portion of the wall adjacent to which it is applied, is such that it can be placed relatively close to the skeleton components. Consequently, during operation of a temperature control facility according to the invention, heat can be transmitted by thermal conduction and/or radiation coupling between the parts in operation. It has been found that this very simple, inexpensive method can provide satisfactory temperature control in buildings, even in those in which the temperature control facility has been installed subsequent to their construction.

In an advantageous embodiment of the invention, the temperature-control facility comprises a single pipe integral with a heat-transmitting section member. The pipe may have a round cross-section and its internal diameter is preferably 22 mm.

To improve the thermal conductivity, the pipe and the heat-transmitting section member are preferably made of aluminum.

Preferably the heat-transmitting section member has a hollow cross-section, for example a rectangular or box-shaped section. The outer edge lengths of the rectangle are advantageously 100×60 mm.

The temperature control facility may itself be secured to the appropriate skeleton component, adjacent to which is placed the outside portion of the heat-transmitting section member remote from the pipe in connection therewith which contains the heat-transmitting or transfer medium. Since, in the preferred embodiments, the heat-transmitting section member is directly adjacent the appropriate part of the skeleton, where heating is to be achieved the heat from the pipe, which is integral with the heat-transmitting section member, is transmitted directly by conduction, from the pipe to the skeleton member, during operation of the temperature control facility. The pipe, which preferably has an internal diameter of 22 mm, and the heat-transmitting section member, which is hollow and preferably has edge lengths of 100×60 mm, provide good heat transmission, more particularly if both parts are made of aluminium, using a relatively small amount of heat transmitting medium in circulation since the pipe has a small internal diameter. This is a plus factor in using the invention.

In another advantageous embodiment, the temperature control facility is disposed at a relatively short distance from the metal skeleton to provide a close radiation coupling between the skeleton and the temperature control facility. The advantage of the last-mentioned arrangement is that, since there is no contact between the skeleton and the control facility, there is no need to shape the outer surface of the skeleton alongside the control facility. There is also no risk of corrosion resulting from contact therebetween. As a result, the wall of the building to which the control facility is so applied is not subjected to any damage.

A temperature-control facility according to the invention can be easily and rapidly disposed at a number of different parts of the skeleton of a building, more particularly at its vertical uprights and horizontal beam members, with practically no limitations regarding the dimensions of the skeleton components. It is only necessary to secure the control facility to a few places on the building wall, more particularly at the location of the inlet and outlet of the piping system of the temperature control facility.

The invention control facility can be adapted to the shape of existing rooms since, in practice, only an existing wall pattern is used. Since the skeleton of columns and horizontal members of a room wall structure is insulated from the room exterior and since the applied temperature control facility will be directly aligned relative to the skeleton at the inside of the room, there will be an increase in the intensity of radiation from the skeleton component to the room side, i.e. in a plane parallel to the wall which usually contains window areas. As a result, people who sit by a temperature-controlled part of the skeleton near a window in winter experience pleasant heat radiation in spite of the cold window surfaces to the extent that comfort is maintained or increased near the wall. The aforementioned increased comfort during winter also occurs in summer, particularly when solar radiation acts at an angle on the skeleton components through the windows, and the components discharge the incident heat of radiation together with the heat radiated by people near the window by way of the temperature control facility in that area to that portion of the system bounding a room at the shady side of the building the temperature of which is too cool. In this last respect it has been found in operation of preferred embodiments of the invention that as a result of the rapid removal of heat by the heat transmitting fluid in the pipe system of the temperature control facility, there are no effects of radiation on that side of the facility which extends towards the interior of the room. This practically eliminates side effects of radiation on room temperature.

In one embodiment, in normally-sized rooms, the temperature control facility is disposed about 50 mm from the associated skeleton component, thus obtaining the advantages of the aforementioned freedom from contact together with optimum radiation coupling between the parts in operation.

In another embodiment, the pipe system of a control facility may comprise a double or multiple pipe through which parallel flow occurs, at least part of the way between the inlet and the outlet thereof. As a result, particularly efficient temperature control can be obtained even in the case of a skeleton member which is particularly wide or has a large surface. The individual pipe sections can have the same diameter, thus simplifying manufacture.

In another particularly advantageous embodiment, the pipe system also comprises a radiation-reflecting part which is integral with the pipe and extends along the heat-transmitting regions between the inlet and the outlet thereof. The result is a further improvement in the temperature-control effect, which is surprisingly self-adjusting. The control facility is particularly simple to manufacture and the amount of heat-transmitting fluid required in the system is a minimum. The radiation-reflecting part can have a U-shaped cross-section arranged so the free ends of the U extend substantially towards the associated skeleton component. Alternatively the radiation-reflecting part can have a parabolic cross-section, the pipe or pipes lying near the radiation centre or focus and the free longitudinal edges of the radiation-reflecting part extending substantially towards the associated skeleton component. Accordingly, this last-mentioned embodiment of the control facility is trough-shaped making optimum use of heating technology. Its concave wall can point towards the interior of the room. In addition to its heating advantages, this embodiment can take account of architectural considerations without any appreciable increase in manufacturing costs, and has the additional advantage of reducing the risk of injury to persons in the room.

The radiation-reflecting part can be internally coated with a reflecting medium, i.e. on the wall facing the associated skeleton part. Advantageously the radiation-reflecting part has the same width as the associated skeleton part.

In another advantageous embodiment of the invention the piping system of the temperature control facility is made up of straight pipes which are substantially perpendicular to one another. This system can be constructed in a particularly simple manner from easily manufactured components. Such components are particularly advantageous when a temperature control facility is subsequently incorporated in existing buildings, since the system is easy to handle until it is finally installed. The process of assembling the individual components is most simple if a screw plug is provided at the dead ends at the junctions between pipes meeting perpendicularly, particularly if the perpendicularly-connected pipes are screwed together at the junctions. The need to weld the individual parts may thus be eliminated. The assembly process, therefore, can be free from the disadvantageous effects of welding, more particularly changes in the microstructure of the welded parts and the risk of corrosion or changes in the shape of components owing to the heat of welding, with consequent localised stress concentrations.

A particularly simple embodiment of the invention avoiding a welded connection between pipes is characterized in that the large part of an externally threaded bushing is screwed into one end of a pipe and has axially extending, more particularly closable apertures for passing the heat-transmitting fluid and an axially extending central threaded bore for receiving a screw bolt which extends through the second pipe (which is perpendicular to the first pipe) and clamps it to the first pipe, sealing rings being provided between the connected parts.

Alternatively, the screw connection may advantageously be as follows:

An externally threaded sleeve is screwed in the end of one pipe and most of it projects from the pipe through the second pipe, which is perpendicular to said end of the first pipe, and a threaded screw closure means is secured to the end of the sleeve in the second pipe in an arrangement which secures the first pipe in sealing-tight manner to the second pipe via the sleeve, the latter of which has radial apertures, more particularly closable, for the heat-transmitting medium inside the second pipe.

The bushing and sleeve can easily be produced by extrusion moulding, and advantageously have six holes for the heat-transmitting fluid to pass from one pipe to the connected pipe.

The temperature control facility according to the invention can also be connected to a control component disposed inside the room in which it is applied, for making fine or rapid adjustments to its temperature.

In another particularly advantageous embodiment of the invention, the temperature-control facility also comprises an air-supply system.

The air supply system can substantially comprise hollow heat-transmitting sectional members. In view thereof the above referred to heat-transmitting or heat transfer fluid system can be disposed parallel to the air supply system so as to exchange heat therewith during operation, as the heat transmitting fluid and the air move in parallel, counter-current or co-current flow relation. In a winter operation, therefore, the external supply of cold air can be heated by the temperature-control facility of the invention itself before being discharged into a room, whereas in summer, when the external air supply is warm, the air can be cooled before it enters the room. In this manner, a temperature control facility constructed according to the invention can be made particularly compact and can also be used as an aeration system. Another embodiment of the invention is characterized in that the air supply system utilized is arranged to a have a common external-air supply for a predetermined number of storeys. Advantageously, the external air supply is introduced at the ceiling in the top storey of a building. A particularly compact construction is obtained if the air supply system is conveyed through successive intermediate storeys of a building. The temperature control and ventilation of a room are particularly efficient if the air stream conveyed into the interior of a storey is provided substantially at the floor. In order to deliver air into the rooms, transverse hollow members are advantageously formed with air slots, more particularly in the longitudinal direction of the transverse members. Air passing through the individual storeys of a building is conveyed mainly through hollow vertical members of its wall structure, whereas the air is delivered into its rooms through transverse members.

Figure 1B:
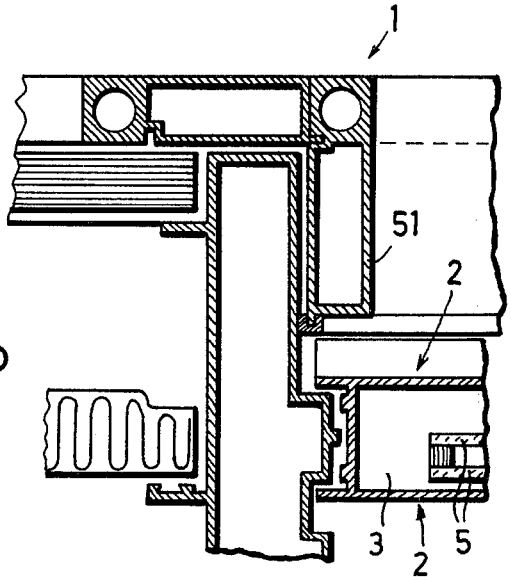
Figure 1C:
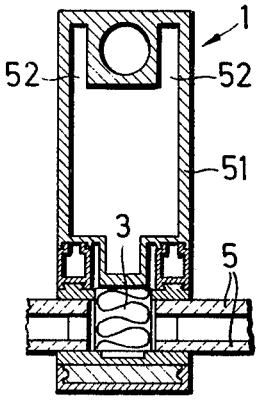
Figure 1D:
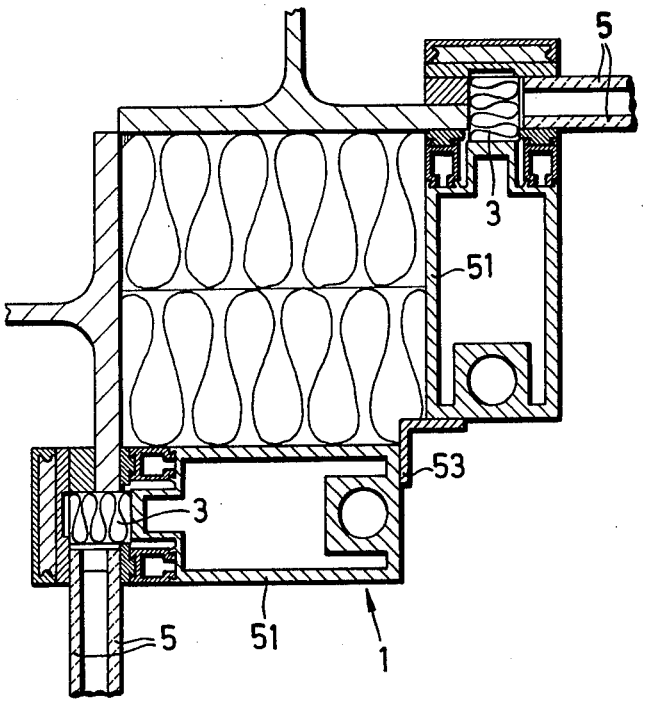
Figure 1E:
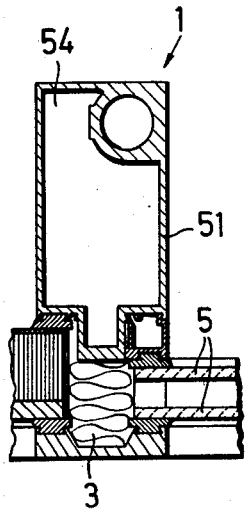
Figure 1F:
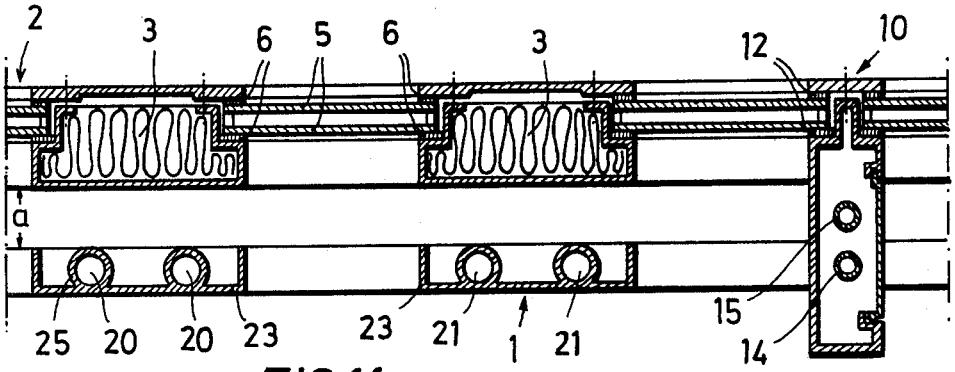
Figure 8:
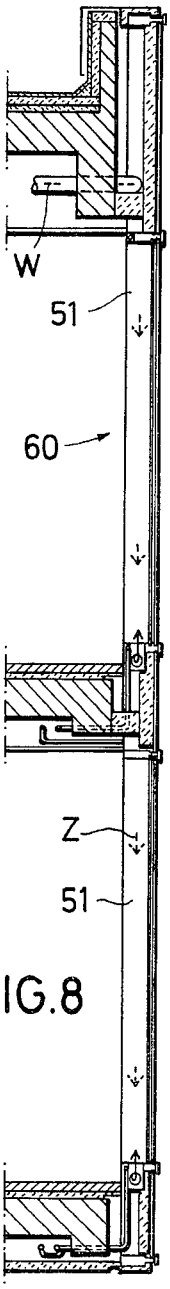
Figure 9:
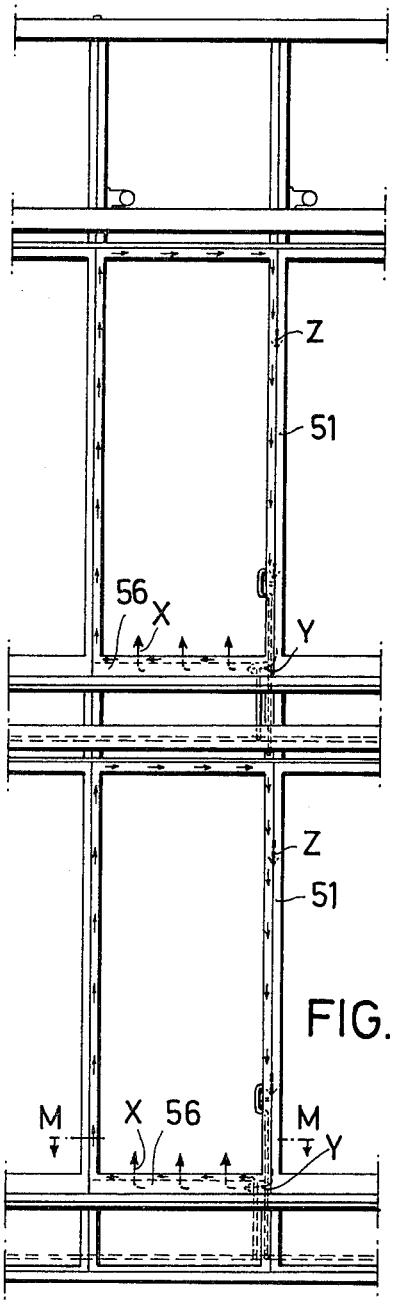
Figure 10:
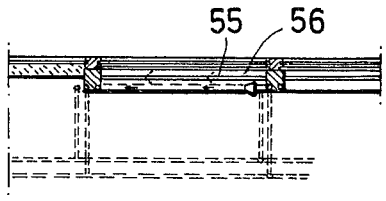

Embodiments of the invention are now described in detail with reference to the accompanying drawings, in which:

FIG. 1*a* shows a detail of a temperature control facility according to the invention, taken in horizontal section through a wall of a building, FIG. 1*b* shows another detail of a temperature control facility according to the invention secured to a wall, taken in a horizontal section through a wall of a building, FIG. 1*c* is a sectional view showing a detail of a temperature control facility according to the invention and corresponding to FIGS. 1*a* and 1*b*, wherein the facility directly abuts the associated skeleton component;

FIG. 1*d* shows how the temperature control facility according to FIG. 1*c* is disposed in the corner of a building, FIG. 1*e* is a detail of a temperature control facility corresponding to FIG. 1*c* which directly abuts the associated skeleton member, FIG. 1*f* shows a detail of a temperature control facility according to the invention, including the attachment to the wall, in horizontal section through a wall of a building, FIG. 2 shows a detail of the temperature control facility according to FIG. 1 in the neighborhood of a bend in the piping system, along section I—I in FIG. 3, FIG. 3 is a side view of the detail in FIG. 2, showing a pipe bend in a temperature control facility according to the invention, FIG. 4 is a side view, corresponding to FIG. 3, of a pipe bend in the case of horizontal double pipes and a vertical connecting portion, FIG. 5 is a section along line II—II in FIG. 4, FIG. 6 shows another embodiment of a pipe connection corresponding to FIGS. 3 to 5, FIG. 7 is a section through the pipe connection in FIG. 6, along line III—III, FIG. 8 is a view of a building in vertical section through one outside wall and three floors of the building, the building being fitted with a temperature regulating system embodying the invention and incorporating additionally a ventilation system, FIG. 9 is a diagrammatic side elevation view of the building of FIG. 8, looking towards the outside wall shown in FIG. 8, and FIG. 10 is a view in horizontal section through said outside wall of FIGS. 8 and 9 on the line M—M of FIG. 9.

FIG. 1*a* is a horizontal section through the wall or facade 2 of a building, showing a temperature control facility 1 according to the invention comprising a single pipe constructed integrally with a heat-transmitting or heat transfer section member 51. As seen in cross-section, the member 51, which is a longitudinally extended duct-like structure, has a box-like rectangular hollow configuration and the side wall portion thereof which disposes innermost of a room is relatively thickened and formed with a longitudinally extended passage coextensive therewith, thereby to define the embodied pipe. Thus, that region of member 51 which is furthest from the pipe of facility 1, as shown in FIG. 1*a*, is positioned near the associated skeleton member 3, which is to be temperature-controlled. The aforementioned region can be practically adjacent or secured to the associated skeleton member 3, so that heat is transmitted by conduction and/or radiation during operation. In the present case, heat transfer from structure 2 to structure 1 can be used for heating purposes by conveying heating or cooling water applied in the pipe from the sunny side to the shady side of the building as previously described. This last results in indirect heat transmission from the hot to the cold side of the building.

FIG. 1*b* shows a horizontal section through the wall or facade 2, to which glass panes 5 are secured. It shows a temperature-control facility 1 which, as in FIG. 1*a*, comprises a heat-transmitting section member 51 disposed close to the associated skeleton member 3 or, if required, abutting or secured to member 3. The embodiment in FIG. 1*b* has substantially the same advantages as the structure according to FIG. 1*a*.

FIG. 1*c* shows a horizontal section corresponding to the embodiments in FIGS. 1*a* and 1*b* wherein an aluminium pipe, formed integrally with the heat-transmitting section member 51 and containing the heat-transmitting medium, does not completely fill the corresponding internal box-like cross-section of member 51. In this case there are recesses or channels 52 defined to opposite sides of the pipe which open to the chamber defined inwardly of the pipe along the length of the member 51. These recesses have the advantage of saving a considerable amount of material without reducing the stability of the temperature-control facility or the efficiency of heat transfer from the pipe to the associated skeleton member 3.

FIG. 1*d* shows an embodiment of a facility 1 according to FIG. 1*c* in a corner connection, wherein the two temperature-control facilities 1 connected at the corner are also connected by a bent aluminium member 53 in the neighborhood of the piping, resulting in a heat bridge between the two connected temperature-control facilities.

FIG. 1*e* shows an embodiment of a facility 1 which, to some extent, is a combination of the facilities in FIGS. 1*a* and 1*c* but has only a single internal recess 54 in the pipe region of facility 1. This results in a comparatively wide internal recess 54, leaving enough space to receive other structural or securing components such as screws.

The embodiments of a temperature-control facility 1 such as shown in FIGS. 1*a* to 1*e* have a single pipe line formed integrally with a heat-transmitting section member 51. They have a common feature in that comparatively little heat-conveying liquid flows through the temperature-control facility during operation, i.e. no flow occurs through most of the hollow-section temperature-control facility other than in the wall portion of member 51 embodying the pipe, yet good and efficient heat transfer is ensured. An advantageous result of the small amount of heat transfer fluid in circulation is that the temperature of a room in a building can be easily and rapidly adjusted, so that abrupt large changes in the environmental temperature can be very efficiently compensated.

FIG. 1*f* is a horizontal section through a wall or facade 2 showing a facility 1 according to the invention comprising two double pipes disposed at a distance a from vertical columns of a skeleton 3 which is to be temperature controlled. The double pipes are aligned relative to the skeleton parts which are to be temperature-controlled so as to provide radiation coupling between facility 1 and the associated parts 3 during operation.

Facility 1 is in the form of a piping system secured to facade 2 at 10, near the inlet 14 and the outlet 15 of the piping system of facility 1. In the embodiment shown in FIG. 1*f*, the building facade comprises vertical columns of a metal skeleton 3 made up of columns and horizontal members and securing double glass panes 5, leaving insulation cavities 6 between panes 5 and the columns. In the neighborhood of places 10, the columns can be integral parts of facade 2 as shown in FIG. 1, and can secure facade elements or glass panes 5, likewise via insulating cavities 12.

The temperature control facility 1 in FIG. 1*f* is not in contact with the associated skeleton parts but at a distance a, preferably 50 mm, thus ensuring optimum radiation coupling between the parts in operation.

The radiation coupling between the operating parts of the facility in FIG. 1*f* is further improved by constructing the pipe system in the form of double pipes 20, 21 and a radiation-reflecting part 23, which is integral with each double pipe 20, 21 and has a U-shaped cross-section. When the facility 1 is installed, the free ends of the U point towards the skeleton members 3 which are to be temperature-controlled.

Preferably the width of the radiation-reflecting part 23 is dimensioned to correspond to the width of the associated skeleton component 3 to be temperature-controlled.

Instead of a U-shape cross-section, part 23 can have a parabolic cross-section in which case, according to an advantageous embodiment of the invention, the individual pipe or pipes 20, 21 lie near the focus of the parabola.

The inner surface of the radiation-reflecting part 23, which faces towards the skeleton part 3 to be temperature-controlled, may be suitably coated so as further to increase the heat exchange between component 3 and facility 1 when the facility is in operation.

FIG. 2 shows the left portion (in FIG. 1*f*) of the temperature control facility 1 in the neighborhood of a pipe bend, shown in greater detail in FIG. 3.

The pipe bend according to the invention is produced as follows:

Straight individual pipes 25 are connected to a pipeline 26 disposed perpendicularly thereto, so that flow can occur from one pipe to the other, by means of a screw connection. This avoids the disadvantages of a welded connection.

As shown in FIG. 3 each screw connection is more particularly an externally threaded bush 32 screwed in the end 31 of a perpendicularly extending individual pipe 25. As can be seen more clearly in FIG. 2, bush 32 has axially extending apertures 33 for heat-transfer fluid 35 travelling in the direction of arrow A, and also has an axially extending central threaded bore 34. The threaded bore 34 receives a screw bolt 36 which extends through pipe 26 and clamps it to pipe 25, which extends perpendicular to pipe 26. Sealing rings 37 and 38 are provided in order to obtain a liquid-tight pipe union between the connected parts.

As can be seen, a screw connection of the aforementioned kind is a simple way of connecting individual pipes (mainly standard components) so that a flow can occur from one pipe to the other and so that the resulting temperature-control facility can be installed in an existing building. Dead ends of pipes, more particularly the end 29 of header 26, can receive a screw plug 30, thus to reliably prevent leaks.

FIGS. 4 and 5 show a junction 28 between individual pipes at right angles to one another, using a bush 32 and a threaded bolt 36 as in FIG. 3. In FIG. 4, in contrast to the embodiment in FIG. 3, two horizontal pipes 26 connect to one vertical pipe 25 for disposition in a radiation coupling relation to horizontal members of a wall skeleton.

The aforementioned connection can also be used for the inlet or outlet of the temperature control facility.

The components in FIGS. 4 and 5 correspond to those in FIG. 3, like parts being given like references.

FIGS. 6 and 7 show another embodiment of a screw connection at the bend between two pipes which are to be connected so that a flow occurs from one pipe to the other, the pipes being at right angles to one another. One pipe 43 has an end 31 internally threaded and in screw-threaded engagement with one end of a sleeve 40 having an external thread 41. Most of sleeve 40, in contrast to bushing 32 in FIGS. 2 to 5, projects from pipe end 31 and extends through the second pipe or tube 44, which is at right angles to end 31. The opposite end 46 of sleeve 40 has an internal thread 47 receiving a threaded closure means 48. Sealing rings 37 and 38 are interposed to connect pipe 43 in fluid-tight manner to pipe 44 via sleeve 40. Exposed inside pipe 44, sleeve 40 has radial apertures 49 for the heat-conveying fluid 35, so that the fluid can flow through apertures 49 in the direction of arrow A during operation.

Depending on the required flow resistance, the radial apertures 49 can be closed to obtain uniform flow resistance in the system, to the extent required.

The axial flow apertures 33 in bush 32 according to FIGS. 2 to 5 can be closed similarly. The closure means for the individual apertures can be plugs or valves or washers or bushes incorporated with the sleeve and partly covering the axial apertures 33 or the radial apertures 49. Individual apertures can be steplessly closed if it is desired to make fine adjustments in the flow resistance of an individual flow system.

A special advantage of the invention system described for controlling the temperature of rooms is that the inlet and outlet or return temperatures of applied fluid can be low during operation. If a temperature difference of e.g. 6° C. is chosen between the inlet and the outlet, the inlet temperature can of course be relatively low, whereas if a greater temperature difference is chosen, the inlet temperatures will be higher and the outlet temperatures will be lower. If the external temperature is e.g. 4° C. during a heating period, the inlet temperature of applied heat transfer fluid will be e.g. 30.9° C. and the outlet or return temperature 22.5° C.

If a room has to be cooled during a heating period as a result of solar radiation and other sources of heat, because the solar radiation and the other sources of heat are together greater than the losses from heat transmission, a mixing valve triggered by a room therostat can connect the relatively cold return flow (at 22.5° C. in the present example) to the inlet pipe of the facade, by cutting off the supply of heat to the room and cooling it via the relatively cold facade surface. If the temperature spread is greater than 20° C., the return temperature can be further lowered to increase the cooling effect.

Cooled uprights in sunlight can be simultaneously used as collectors of solar heat. Owing to the lower water content the temperature can be adjusted more rapidly. Room temperature cannot be similarly adjusted by known low-pressure hot-water heating systems comprising radiators and convectors, because the return temperature is much too high.

It is particularly advantageous to use air as well as a liquid heat-transmitting medium for temperature-control or ventilation in a device embodying the invention. To this end, (see FIGS. 8, 9 and 10) the temperature control facility may also comprise a ventilation system 60 consisting of hollow heat-transmitting sectional members 51, 56. Members 51 are upright members and preferably convey air through individual storeys, whereas members 56 are horizontal and disposed in the floor of each storey and have longitudinal air slots 55 (see FIG. 10) through which temperature controlled air can enter the rooms when the temperature-control facility according to the invention is in operation.

During operation, air from outside, the temperature of which is to be controlled, is supplied through the ceiling to the top storey of a building, as indicated by arrow W in FIG. 8. The air supplied from above then travels along vertical members 51 and flows in the direction of arrow Z downwards, parallel to the heat-transmitting fluid, when heat is exchanged between the two media in co-current or counter-current relation.

Near the floor of a storey, at least some of the air flow is diverted in the direction of arrow Y into the horizontal members 56 and flows through slots 55 into the rooms, as shown in FIGS. 9 and 10.

Between adjacent ceilings, some of the air flowing vertically in the direction of arrow Z is conveyed downwards to lower storeys in order to control the temperature of the rooms underneath.

In summary the invention provides a very simple but highly effective construction for controlling the temperature of rooms in a building which may be installed in existing buildings and without any material modification of their wall structure. There have been exhibited various preferred configurations for those ducts, pipes or similar elements which form part of the pipeline system afforded in accordance with the invention practice. It is to be understood, however, that such configurations are not to be construed as limiting but merely by way of example. There may be substitutions provided the inherent property and arrangement of the configurations exhibited are preserved. A particularly significant benefit is enabled in the use of the invention in that it facilitates a balance of temperatures as between rooms on the sunny side of a building and rooms on the shady side of a building. Most importantly, the invention can in the application of a simple pipeline, singular in nature, and applied to selected wall areas of the interior of an old building produce a condition of comfort in its outer rooms without involved plumbing or related installations.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. Apparatus for controlling the temperature of rooms, used in combination with a building comprising curtain walls having a metal skeleton made up of columns and horizontal members, to which facade elements and, if required, windows are secured, including means defining one surface of said skeleton bounding rooms within said building, said apparatus providing a temperature control facility comprising a pipeline system in which a heat transfer fluid flows, said pipeline system including pipe portions embodied in thermal connection with one or more heat transmitting section members formed of aluminum, mounting adjacent said means defining said one surface of said skeleton, said heat transmitting section members comprising a wall structure having in connection therewith means defining at least one pipe-like flow passage for the heat transfer fluid which affords thereby a pipe portion of said pipeline system.

2. Apparatus as in claim 1 characterized in that said wall structure of at least a portion of said heat transmitting section members has the configuration of a duct and said flow passage is embodied in one portion of said wall structure which disposes innermost of the room to which said temperature control facility is applied.

3. Apparatus according to claim 2 wherein said pipe-like flow passage is round in cross section and the diameter thereof is about 22 mm.

4. Apparatus as in claim 1 or claim 2 wherein at least a portion of said heat transmitting members is generally U-shaped in cross section and nests therein a portion of said pipeline system.

5. Apparatus as in claim 1 characterized in that pipe portions which are embodied in said pipeline system, in connection with heat transmitting section members, are formed as an integral part of said heat transmitting section members.

6. Apparatus according to claim 1 characterized in that at least a portion of said heat transmitting section members comprises a wall structure having a plurality of pipe portions integral therewith, at the surface thereof which in use of said temperature control facility is arranged in facing relation to the skeleton the temperature of which is to be controlled.

7. Apparatus as in claim 1 characterized in that said temperature control facility is disposed at a relatively short distance from and in facing relation to said skeleton in an arrangement producing a close radiation coupling between the skeleton and the temperature control facility.

8. Apparatus as in claim 1 characterized in that said temperature control facility is constructed and arranged to be displaced from the curtain walls of the building to which it is applied, at a distance of approximately 50 mm. from the portion thereof to be temperature controlled thereby.

9. Apparatus as in claim 1 wherein said wall structure of at least a portion of said heat transmitting section members is constructed as a radiation reflecting member having at least one said pipe portion of said pipeline system extending along the length thereof and integral therewith and said radiation reflecting member has a width corresponding to that of a portion of the skeleton, adjacent to which it is applied.

10. Apparatus as in claim 1 characterized in that said pipeline system includes pipe-like portions arranged perpendicular to one another and interconnected by screw-type connector devices.

11. Apparatus as in claim 1 characterized in that said pipeline system includes means defining a pipe-like flow passage for heat transfer fluid at least a portion of which extends longitudinally of and in connection with one side of at least a portion of said heat transmitting section members having a duct form, and said means defining said pipe-like flow passage in said portion of said heat transmitting section members having a duct form is exposed to fluid in said duct, on a plurality of its sides.

12. Apparatus according to claim 1 characterized in that said temperature control facility is connected to an adjusting member for control of the heat transmitting fluid delivered to said pipeline system to make fine or rapid adjustments to the temperature of the room or rooms being serviced by said temperature control facility.

13. Apparatus as in claim 1 wherein said pipeline system nests at least in part in heat transmitting section members which are generally U-shaped in cross section.

14. Apparatus as in claim 1 wherein said pipeline system substantially follows the contours of the skeleton of the building to which it is applied.

15. Apparatus as in claim 1 characterized in that said pipeline system is independent of the curtain walls of the building to which it applies.

16. Apparatus as in claim 1 characterized in that said pipeline system is in combination with the curtain walls of a building to which it is applied and correlated as to its position, with reference thereto, to render said pipeline system effective to utilize both sun and shade applied to the building for controlling the temperature of the room or rooms of the building which it peripherally bounds.

17. Apparatus for controlling the temperature of rooms, used in combination with a building comprising curtain walls having a metal skeleton made up of columns and horizontal members, to which facade elements and, if required, windows are secured, including means defining one surface of said skeleton bounding rooms within said building, said apparatus providing a temperature control facility comprising a pipeline system in which a heat transfer fluid flows, said pipeline system including pipe portions in thermal connection with one or more heat transmitting section members formed of aluminum and mounting adjacent said means defining said one surface of said skeleton to produce a thermal coupling between the skeleton and the temperature control facility, at least a portion of said heat transmitting members being a hollow shell, the hollow of which extends longitudinally thereof, having at least one said pipe portion in connection with and projecting from a portion of the inner surface of said shell.

18. Apparatus according to claim 17 wherein said hollow shell is rectangular in cross section and has a dimension in cross section which is approximately 100×60 mm.

19. Apparatus for controlling the temperature of rooms, used in combination with a building comprising curtain walls having a metal skeleton made up of columns and horizontal members to which facade elements and, if required, windows are secured, including means defining one surface of said skeleton bounding rooms within said building, said apparatus providing a temperature-control facility comprising a pipeline system in which a heat transfer fluid flows, at least a portion of said pipeline system being embodied in thermal connection with one or more heat transmitting section members, formed of aluminum, and mounting adjacent said means defining said one surface of said skeleton to produce a thermal coupling between the skeleton and the temperature control facility, said pipeline system being made up of pipe portions arranged generally perpendicular to one another and interconnected by screw type connector devices constructed to provide passage therethrough for heat transmitting fluids.

20. Apparatus according to claim 19 characterized in that said screw connector devices include at least one such device which is cylindrical in configuration and screwed into one end portion of one of a pair of said generally perpendicular related pipe portions and includes therein an axially extending central threaded bore receiving a screw bolt which is extended through the other of said pair of generally perpendicularly related pipe portions to clamp said perpendicularly related pipe portions together.

21. Apparatus according to claim 19 characterized in that at least one of said screw connector devices comprises a sleeve having an external thread providing for it to be screwed in one end portion of one of a pair of said generally perpendicularly related pipes while a portion thereof projects beyond this end portion and extends into the other of said pair of said generally perpendicularly related pipes to be coupled thereto, and a closure means for one end of said sleeve precludes the loss of fluid from the interior of said pair of generally perpendicularly related pipes while there is communication between said pair of pipes by way of apertures in said sleeve.

22. Apparatus according to claim 21 characterized in that said apertures in said sleeve are adapted for selective closing.

23. Apparatus for controlling the temperature of rooms, used in combination with a building comprising curtain walls having a metal skeleton made up of columns and horizontal members to which facade elements and, if required, windows are secured, including means defining one surface of said skeleton bounding rooms within said building, said apparatus providing a temperature-control facility comprising a pipeline system in which a heat transfer fluid flows, said pipeline system including pipe portions in thermal connection with one or more heat transmitting section members formed of aluminum, and mounting adjacent said means defining said one surface of said skeleton to produce a thermal coupling between the skeleton and the temperature control facility, and an air supply system in association with said temperature-control facility, and at least a portion of said one or more heat transmitting section members forming duct members which are part of said air supply system.

24. Apparatus as in claim 23 embodied in a multistory building and including means defining a common air supply for the various levels of said building.

25. Apparatus as in claim 23 embodied in a multistory building and including means defining a common external air supply for the various levels of said building communicating with the environment exterior to said building and with said heat transmitting section members which are part of said air supply system.

26. Apparatus according to claim 24 embodied in a building characterized by an external supply for said air supply system being provided at the ceiling of the top story of the building.

27. Apparatus according to claim 26 characterized in that said duct members are extended from the top of said building to intermediate levels thereof to convey air to the interior of the rooms of said building substantially at the floor level of each thereof.

* * * * *

UNITED STATES PATENT AND TRADEMARK OFFICE

CERTIFICATE OF CORRECTION

PATENT NO. : 4,458,745

DATED : July 10, 1984

INVENTOR(S) : Karl Gartner

It is certified that error appears in the above-identified patent and that said Letters Patent is hereby corrected as shown below:

Col. 2, line 32, "forms" is corrected to read --flows--.

Col. 5, line 60, "a" (first occurrence) is deleted;

Col. 8, line 15, the comma following "1" is deleted;

Col. 14, line 23 (Claim 24, line 1) "multistory" is corrected to read --multi-story --.

Signed and Sealed this

*Fifteenth* Day of *October 1985*

[SEAL]

*Attest:*

*Attesting Officer*

DONALD J. QUIGG

*Commissioner of Patents and Trademarks—Designate*